US006002094A

United States Patent [19]

Hung

[11] Patent Number: 6,002,094

[45] Date of Patent: Dec. 14, 1999

[54] ELECTRIC SWITCH

[76] Inventor: Tang-Yueh Hung, No. 192, Shu Ren Road, Wu Feng Hsian, Taichung Hsien, Taiwan

[21] Appl. No.: 09/285,765

[22] Filed: Apr. 5, 1999

[51] Int. Cl.[6] ..... H01H 5/08

[52] U.S. Cl. ..... 200/438

[58] Field of Search ..... 200/238, 284, 200/339, 438, 439, 402–472

[56] References Cited

U.S. PATENT DOCUMENTS

| | | | |
|---|---|---|---|
| 2,987,592 | 6/1961 | Johnson | 200/67 |
| 3,670,121 | 6/1972 | Howe | 200/67 G |
| 4,924,047 | 5/1990 | Tsuge | 200/553 |
| 4,982,061 | 1/1991 | Dignal | 200/302.3 |

*Primary Examiner*—Michael L. Gellner
*Assistant Examiner*—Nhung Nguyen
*Attorney, Agent, or Firm*—Browdy and Neimark

[57] ABSTRACT

An electric switch comprises a housing which is provided therein with a receiving cell having in the bottom thereof two through holes. Located in the receiving cell are a first fixed conducting member and a second fixed conducting member which is pivoted with a movable conducting member capable of swiveling between the first and the second fixed conducting members. A switch member is pivoted with the housing and provided at the bottom thereof with a push rod for pushing the movable conducting member to be connected or disconnected with the first fixed conducting member, thereby resulting in the connection or the disconnection of electric circuit.

4 Claims, 3 Drawing Sheets

ELECTRIC SWITCH

FIELD OF THE INVENTION

The present invention relates generally to an electric circuit device, and more particularly to an electric switch for connecting or disconnecting the electric circuit.

BACKGROUND OF THE INVENTION

As shown in FIG. 1, an electric switch 10 of the prior art comprises a housing 11 which is provided with a receiving cell 12 in which a first fixed conducting piece 13 and a second fixed conducting piece 14 are disposed. A movable conducting piece 15 is pivoted with the first fixed conducting piece 13. A switch lever 16 is provided at the bottom thereof with a push rod 17 which is in turn provided at the bottom end thereof with a rolling ball 171. The switch lever 16 is pivoted with the housing 11 such that the rolling ball 171 is in contact with the movable conducting piece 15 and is urged by a spring 173 so as to keep the rolling ball 16 in the state of being constantly in contact with the movable conducting piece 15. In operation, the switch lever 16 is actuated such that the movable conducting piece 15 is pushed by the rolling ball 171 to swivel so as to become connected or disconnected with the second fixed conducting piece 14.

Such a prior art electric switch 10 as described above is defective in design in that the assembly of the electric switch 10 is rather inefficient and time-consuming in light of the special arrangement of the rolling ball 171 which must be urged constantly by the spring 173 and must urge the movable conducting piece 15 at the same time. In addition, the rolling ball 171 is vulnerable to being ejected from the bottom end of the push rod 17 at the time when the switch lever 16 is displaced.

SUMMARY OF THE INVENTION

It is therefore the primary objective of the present invention to provide an electric switch which is simple in construction.

It is another objective of the present invention to provide an electric switch which can be made efficiently.

It is still another objective of the present invention to provide an electric switch which has a low failure rate.

The foregoing objectives of the present invention are attained by an electric switch comprising a housing which is provided with a receiving cell having in the bottom thereof a plurality of through holes. Located in the receiving cell are a first fixed conducting member and a second fixed conducting member which is fastened pivotally with a movable conducting member capable of swiveling between the first fixed conducting member and the second fixed conducting member. A switch member is pivoted with the housing and is provided at the bottom thereof with a push rod which urges the movable conducting member to displace. The movable conducting member has a curved body, which is fastened pivotally with a curved arm of the second fixed conducting member. The movable conducting member is actuated by the switch member to be connected or disconnected with the first fixed conducting member, thereby resulting in the connection or the disconnection of electric circuit.

The foregoing objectives, features, functions, and advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
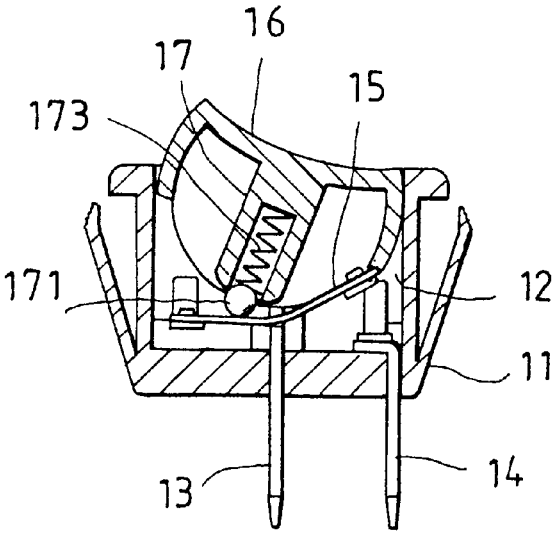
FIG. 1 PRIOR ART
FIG. 1 shows a longitudinal sectional view of an electric switch of the prior art.
Figure 2:
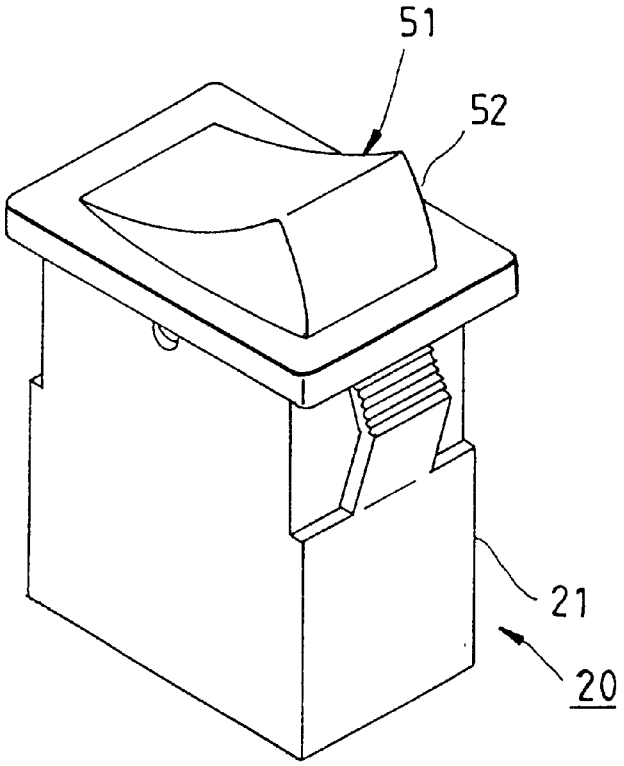
FIG. 2 shows a perspective view of the preferred embodiment of the present invention.
Figure 3:
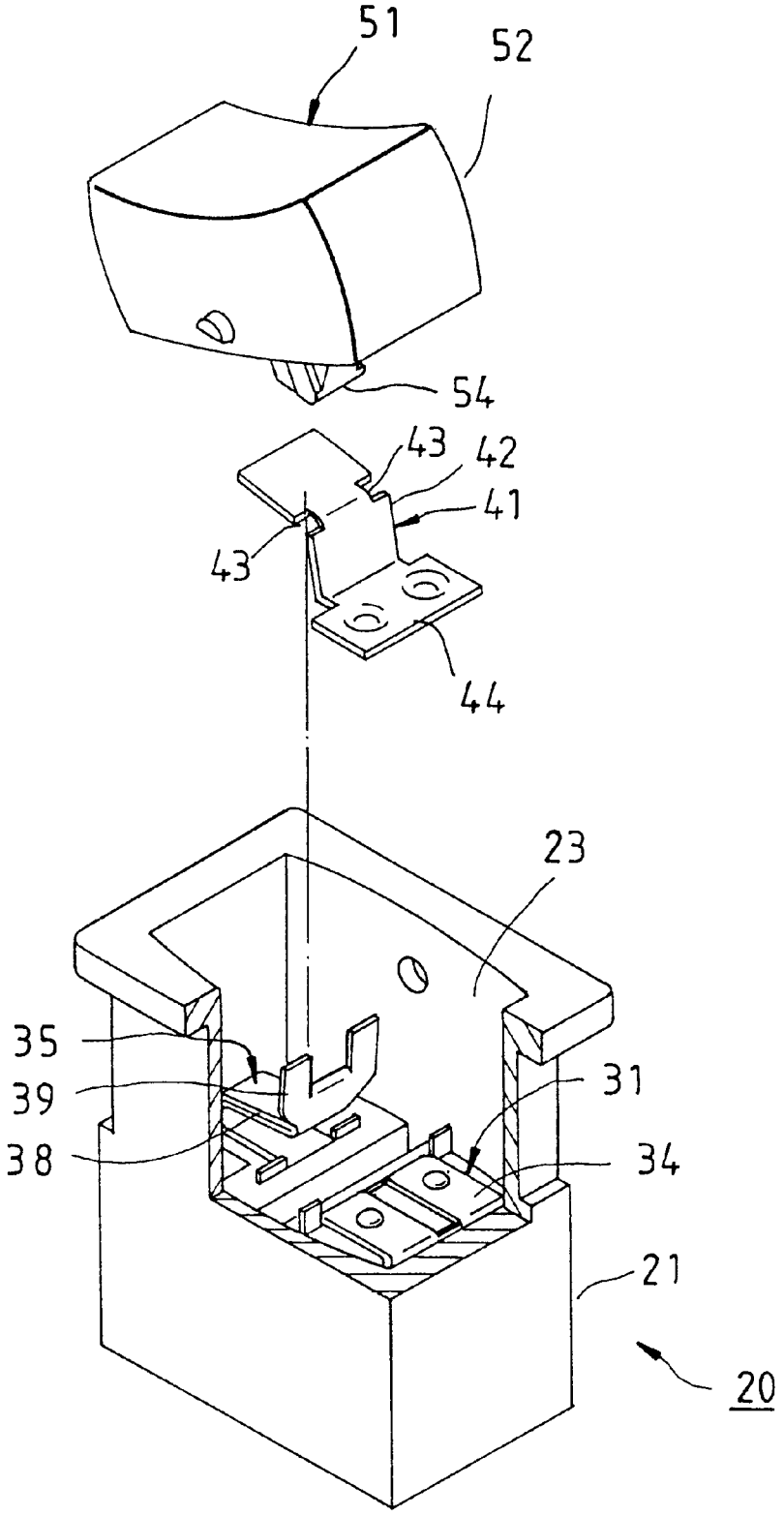
FIG. 3 shows an exploded view of the preferred embodiment of the present invention.

As shown in all drawings provided herewith, an electric switch 20 embodied in the present invention is composed of a housing 21, a first fixed conducting member 31, a second fixed conducting member 35, a movable conducting member 41, and a switch member 51.

The housing 21 is provided therein with a receiving cell 23 having an opening that faces upward. The receiving cell 23 is provided respectively in both sides thereof with a through hole 25 extending through the bottom thereof.

The first fixed conducting member 31 has a body 32 which is disposed in one of the through holes 25 in which a first holding portion 33 is formed for holding a wire extending thereinto from the bottom of the housing. The first fixed conducting member 31 is provided at the top thereof with a flat portion 34.

The second fixed conducting member 35 has a body 36 which is disposed in another through hole 25 in which a second holding portion 37 is formed. The second fixed conducting member 35 is provided at the top thereof with a curved arm 38 extending slantingly into the receiving cell 23. The curved arm 38 is provided at the top end thereof with two lugs 39. Both the first and the second fixed conducting members 31 and 35 are extended downward through the housing 21 via the two through holes 25 for connecting with the wires.

The movable conducting member 41 has a curved body 42 which is provided with two retaining cuts 43 opposite to each other. The movable conducting member 41 is pivoted to the second fixed conducting member 35 such that the two retaining cuts 43 of the movable conducting member 41 retain the two lugs 39 of the second fixed conducting member 35, and that the movable conducting member 41 is capable of swiveling on the retaining portion serving as a pivot. The body 42 is provided with a flat contact portion 44 which is located at other end thereof opposite to the cuts 43.

The switch member 51 has a body 52 which is provided with a push rod 54 extending from the bottom thereof. The switch member 51 is pivoted with the housing 21 such that the bottom end of the push rod 54 urges the body 42 of the movable conducting member 41. The movable conducting member 41 can be thus actuated to swivel by the push rod 54 of the switch member 51.

Figure 4:
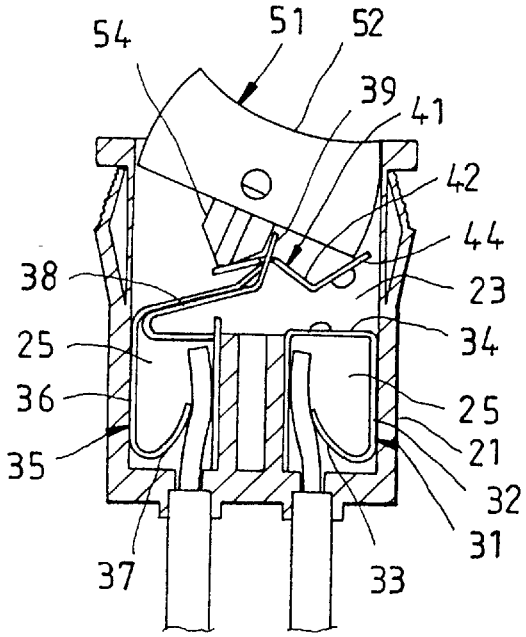
FIG. 4 shows a longitudinal sectional view of the preferred embodiment of the present invention in the "OFF" state.
Figure 5:
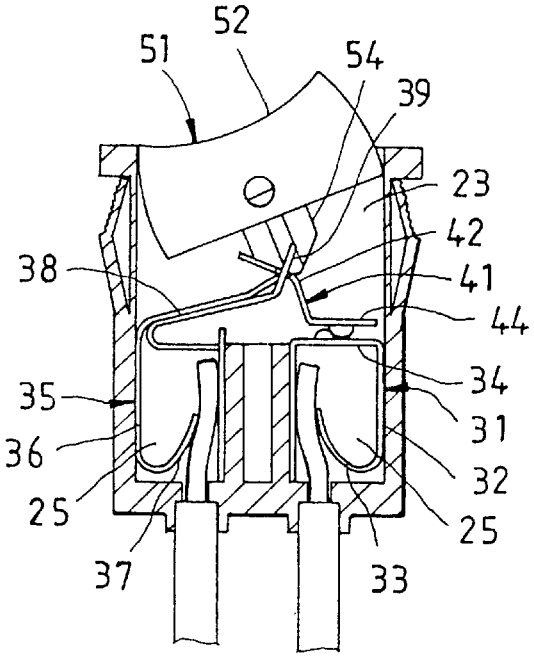
FIG. 5 shows an operational schematic view of the preferred embodiment of the present invention in the "ON" state.

In operation, both ends of the body 52 of the switch member 51 can be pressed with finger to actuate the push rod 54 to swing leftward or rightward so as to trigger the movable conducting member 41 to swivel, as shown in FIG. 4. Now referring to FIG. 5, the switch member 51 is shown being switched leftward to cause the push rod 54 to swing rightward. As a result, the movable conducting member 41 is pushed by the push rod 54 to swivel clockwise so as to enable the contact portion 44 to come in contact with the flat portion 34 of the first fixed conducting member 31, thereby resulting in the opening of the electric circuit and the conduction of electricity between the first fixed conducting member 31 and the second fixed conducting member 35.

As the switch member 51 is switched rightward, the movable conducting member 41 is actuated to swivel counterclockwise so as to cause the contact portion 44 to move away from the flat portion 34 of the first fixed conducting member 31 to return to the position shown in FIG. 4.

The electric switch 20 of the present invention has advantages over the electric switches of the prior art. In the first place, the electric switch 20 of the present invention is relatively simple in construction and is therefore cost-effective. For example, the switch member 51 and the push rod 54 of the present invention are made integrally to simplify the construction of the present invention. The present invention is devoid of the prior art components, such as the rolling ball, the elastic member, etc., which complicate the construction of the electric switch. In addition, the assembly of the electric switch 20 of the present invention can be done with ease and speed to result in a further reduction in cost of making the electric switch 20 of the present invention. The case in point is the switch member 51 of the present invention which can be directly mounted over the movable conducting member 41 without the use of additional tools. In light of the advantages of the present invention over the prior art, the electric switch 20 of the present invention is relatively free from failure, thanks to the switch member 51 and the push rod 54 which are made integrally to ensure that the push rod 54 keeps urging the movable conducting member 41 while the electric switch 20 is in operation.

What is claimed is:

1. An electric switch comprising:

a housing provided therein with a receiving cell having an open top and a plurality of through holes extending through a bottom thereof;

a first fixed conducting and a second fixed conducting member, which are disposed in said through holes;

a movable conducting member pivoted with said second fixed conducting member such that said movable conducting member can be caused to swivel between a first position and a second position; and a switch member pivoted with said housing such that said switch member is located over said movable conducting member, said switch member provided with a push rod extending therefrom and capable of urging said movable conducting member to displace at the time when said switch member is actuated to swivel by an external force;

wherein said second conducting member has a curved arm; wherein said movable conducting member has a curved body engageable with said curved arm; wherein said movable conducting member is pushed by said switch member in motion to swivel to make contact with said first fixed conducting member so as to result in the connection of an electric circuit; and wherein said movable conducting member is pushed by said switch member is motion to swivel to move away from said first fixed conducting member so as to bring about the disconnection of the electric circuit.

2. The electric switch as defined in claim 1, wherein said curved body of said movable conducting member is provided with two retaining cuts; wherein said curved arm of said second fixed conducting member is provided with two lugs; and wherein said movable conducting member is pivoted with said second fixed conducting member in such a manner that said two lugs are retained in said two retaining cuts.

3. The electric switch as defined in claim 1, wherein said movable conducting member is provided at one end thereof with a contact portion to come in contact with said first fixed conducting member so as to bring about the connection of the electric circuit.

4. The electric switch as defined in claim 1, wherein said switch member and said push rod are made integrally.

* * * * *